US012102112B2

(12) United States Patent
Xie et al.

(10) Patent No.: US 12,102,112 B2
(45) Date of Patent: Oct. 1, 2024

(54) CIGARETTE CORE MATERIAL CAPABLE OF BEING IGNITED AND HEATED AT LOW TEMPERATURE FOR SMOKING AND PREPARATION METHOD THEREOF

(71) Applicant: HONGYUN HONGHE TOBACCO (GROUP) CO; LTD., Yunnan (CN)

(72) Inventors: Wei Xie, Yunnan (CN); Bingqiang Cao, Yunnan (CN); Yonglin Zhang, Yunnan (CN)

(73) Assignee: HONGYUN HONGHE TOBACCO (GROUP) CO; LTD., Yunnan (CN)

( * ) Notice: Subject to any disclaimer, the term of this patent is extended or adjusted under 35 U.S.C. 154(b) by 1052 days.

(21) Appl. No.: 16/980,847

(22) PCT Filed: Jul. 22, 2019

(86) PCT No.: PCT/CN2019/096976
§ 371 (c)(1),
(2) Date: Sep. 15, 2020

(87) PCT Pub. No.: WO2020/177266
PCT Pub. Date: Sep. 10, 2020

(65) Prior Publication Data

US 2021/0368854 A1 Dec. 2, 2021

(30) Foreign Application Priority Data

Mar. 7, 2019 (CN) ..... 201910172810.8

(51) Int. Cl.
*A24B 15/18* (2006.01)
*A24B 15/10* (2006.01)

(52) U.S. Cl.
CPC ..... *A24B 15/186* (2013.01); *A24B 15/10* (2013.01)

(58) Field of Classification Search
CPC ..... A24B 3/14; A24B 13/00; A24B 15/186
See application file for complete search history.

(56) References Cited

U.S. PATENT DOCUMENTS 4,799,501 A * 1/1989 Liebe et al. ..... A24B 3/18 131/299
2004/0255965 A1* 12/2004 Perfetti et al. ..... A24B 15/00 131/353

FOREIGN PATENT DOCUMENTS

| | | | | |
|---|---|---|---|---|
| CN | 101843361 A | | 9/2010 | |
| CN | 105768209 A | | 7/2016 | |
| CN | 107635415 A | | 1/2018 | |
| CN | 207444265 U | | 6/2018 | |
| CN | 108835714 A | | 11/2018 | |
| CN | 109288121 A | * | 2/2019 | ..... A24B 3/14 |
| WO | WO2018100366 A2 | | 6/2018 | |
| WO | WO2018214953 A1 | | 11/2018 | |

OTHER PUBLICATIONS

CN109288121A_Espacenet Machine_English_Translation (Year: 2019).*

* cited by examiner

*Primary Examiner* — Christopher M Rodd
*Assistant Examiner* — Ronnie Kirby Jordan
(74) *Attorney, Agent, or Firm* — Li & Cai Intellectual Property Office

(57) ABSTRACT

A cigarette core material capable of being ignited and heated at low temperature for smoking includes 50-95% of slice shreds and 5-50% of cut tobacco by weight percentage. The slice shreds include 40-55% of tobacco film bases, 15-25% of tobacco refined extracts, 0-5% of flavors and fragrances, and 15-30% of smoke additives by weight percentage. The cigarette core material is prepared by mixing the slice shreds with the cut tobacco in a reasonable ratio. The cigarette core material provided by the present invention is able to be heated at low temperature for smoking, and be directly ignited for smoking while the smoking set is out of power, both of which have high-quality sensory experience and can maximize the applicability of cigarette cores. The present invention is a co-product of traditional tobacco and new tobacco. It is also a new product of new market segmentation in the international market.

4 Claims, No Drawings

CIGARETTE CORE MATERIAL CAPABLE OF BEING IGNITED AND HEATED AT LOW TEMPERATURE FOR SMOKING AND PREPARATION METHOD THEREOF

CROSS-REFERENCE OF RELATED APPLICATION

This is a U.S. National Stage under 35 U.S.C 371 of the International Application PCT/CN2019/096976, filed Jul. 22, 2019, which claims priority under 35 U.S.C. 119(a-d) to CN 201910172810.8, filed Mar. 7, 2019.

BACKGROUND OF THE PRESENT INVENTION

Field of Invention

The present invention relates to the field of novel tobacco preparation technology, and more particularly to a cigarette core material capable of being ignited and heated at low temperature for smoking and a preparation method thereof.

Description of Related Arts

In the existing traditional tobacco, the slice shreds account for 4%-15%, causing the tobacco core materials, that can be heated but not burned, cannot release sufficient amount of nicotine and smoke after being heated at low temperature.

For the traditional cigarette products, that can be heated but not burned, currently on sale in the world (Philip Morris' IQOS series products, British American Tobacco's GLO series products), the tobacco core material includes 100% of slice shreds, and can provide consumers with the satisfaction of smoking by baking the slice shreds (nicotine and smoke) at low temperature. However, in some special circumstances, such as when the matching smoking set is exhausted, the traditional cigarette products cannot be smoked; if they are directly ignited, there is only the scorched smell of the reconstituted flakes, which cannot provide consumers with a good tobacco smoking experience. In recent years, foreign tobacco giants represented by Philip Morris have focused on "heating but not burning" cigarette products as the main research direction, but they have not solved the above-mentioned technical deficiencies in tobacco core materials. There is no tobacco core material in the global tobacco market that can guarantee a good sensory experience when it is directly ignited and heated at low temperature for smoking.

At present, the existing domestic researches such as CN 205831054 U discloses a heatable but non-combustible cigarette made from shredded tobacco and reconstituted tobacco, which theoretically uses the high-temperature smoke generated by the heated slices to pass through the non-heated tobacco section to bring out the natural tobacco aroma; such as CN 108451054A proposes to add tobacco fibers, tobacco powders and thermal conductive materials to the cigarette core material for solving the problem of uneven heating. The above two studies closest to the present patent do not involve cigarettes are directly heated at low temperature and ignited for smoking.

In summary, none of the existing low-temperature heating cigarette products currently on sale has the function of being directly ignited for smoking, and there is no disclosure about the low-temperature heating cigarette core material that can be directly ignited for smoking and its preparation method.

SUMMARY OF THE PRESENT INVENTION

To solve the above technical problems, the present invention provides a cigarette core material capable of being ignited and heated at low temperature for smoking and a preparation method thereof, wherein the cigarette core material is prepared through mixing slice shreds with cut tobacco in a reasonable ratio, so as to maintain a better smoking experience while being heated at low temperature and directly ignited, thereby maximizing an applicability of the cigarette core material.

Accordingly, the present invention provides a technical solution as follows.

A cigarette core material, capable of being ignited and heated at low temperature for smoking, comprises 50-95% of slice shreds and 5-50% of cut tobacco by weight percentage.

Preferably, the cigarette core material, capable of being ignited and heated at low temperature for smoking, comprises 70-75% of the slice shreds and 25-30% of the cut tobacco by weight percentage.

Preferably, the slice shreds comprise 40-55% of tobacco film bases, 15-25% of tobacco refined extracts, 0-5% of flavors and fragrances, and 15-30% of smoke additives by weight percentage.

Preferably, the cut tobacco is made of tobacco leaves, tobacco stems, and reconstituted flakes.

Also, the present invention provides a preparation method of the cigarette core material capable of being ignited and heated at low temperature for smoking, the method comprising:

(1) proportionally mixing tobacco refined extracts, flavors and fragrances, and smoke additives, obtaining a coating liquid, applying the coating liquid to tobacco film bases, obtaining slices, drying and shredding, and obtaining slice shreds;

(2) moistening, reinforcing, shredding and flavoring selected tobacco leaves through a traditional shredded tobacco preparation process, and obtaining finished cut tobacco; and (3) proportionally mixing the slice shreds obtained by the step (1) with the cut tobacco obtained by the step (2), and obtaining the cigarette core material.

Preferably, in the step (1), the coating liquid is applied to the tobacco film bases by coating, spraying or dipping.

Preferably, in the steps (1) and (2), a width of both the slice shreds and the cut tobacco is in a range of 0.7 to 1.2 mm.

Preferably, in the step (1), the tobacco film bases are obtained by papermaking method using tobacco foam, tobacco stems and tobacco straw as raw materials; the tobacco refined extracts are water-soluble extracts of tobacco; the flavors and fragrances are one or more members selected from a group consisting of tobacco flavor, tobacco extracts and tobacco extractum; the smoke additives are one or more members selected from a group consisting of propylene glycol, glycerol, propylene glycol acetate, glycerol acetate and polyol.

Preferably, in the step (2), the cut tobacco is made of tobacco leaves, tobacco stems and reconstituted slices.

Beneficial effects of the present invention are as follows.

The cigarette core material provided by the present invention is prepared by mixing the slice shreds with the cut tobacco in a reasonable ratio. While being heated at low temperature, the cigarette core material is able to release nicotine and tobacco flavor in a balanced manner, providing consumers with a smoking experience closer to the flavor of tobacco. When the smoking set is out of power, the cigarette core material is able to be directly ignited for smoking, the aroma is full, there is no irritation of the tongue and the throat, the aftertaste is comfortable, and the sensory experience is good. Compared with the existing cigarette products that are able to be heated but not burned, the cigarette core material provided by the present invention is able to not only be heated at low temperature for smoking, but also be directly ignited for smoking, both of which have high-quality sensory experience, thereby maximizing the applicability of the cigarette core.

The present invention is a co-product of traditional tobacco and new tobacco. It is also a new product of new market segmentation in the international market. Therefore, it has long-term significance in opening the international tobacco market, occupying overseas market shares, enhancing the influence of state-owned tobacco brands and generating foreign exchange income.

DETAILED DESCRIPTION OF THE PREFERRED EMBODIMENT

In order to make the objectives, technical solutions and beneficial effects of the present invention clearer, the preferred embodiments of the present invention will be described in detail as follows to facilitate the understanding of one skilled in the art.

First Embodiment

A cigarette core material, capable of being ignited and heated at low temperature for smoking, comprises 75% of slice shreds and 25% of cut tobacco by weight percentage. The slice shreds comprise 55% of tobacco film bases, 15% of tobacco refined extracts, 5% of flavors and fragrances, and 25% of smoke additives by weight percentage.

A preparation method of the cigarette core material capable of being ignited and heated at low temperature for smoking is also provided, the method comprising:

(1) preparing slice shreds, which comprises:

preparing tobacco film bases by papermaking method using tobacco foam, tobacco stems and tobacco straw as raw materials, proportionally mixing tobacco refined extracts, flavors and fragrances, and smoke additives, obtaining a coating liquid, applying the coating liquid to the tobacco film bases, obtaining slices, drying and shredding the slices for obtaining the slice shreds, wherein a width of the slice shreds is 0.8 mm, the tobacco refined extracts are water-soluble extracts of tobacco; the flavors and fragrances are tobacco flavor or tobacco extracts, the smoke additives are propylene glycol;

(2) moistening, reinforcing, shredding and flavoring selected tobacco leaves through a traditional shredded tobacco preparation process, and obtaining finished cut tobacco, wherein a width of the cut tobacco is 0.8 mm; and (3) proportionally mixing the slice shreds obtained by the step (1) with the cut tobacco obtained by the step (2), and obtaining the cigarette core material.

Second Embodiment

A cigarette core material, capable of being ignited and heated at low temperature for smoking, comprises 85% of slice shreds and 15% of cut tobacco by weight percentage. The slice shreds comprise 50% of tobacco film bases, 20% of tobacco refined extracts, 5% of flavors and fragrances, and 25% of smoke additives by weight percentage.

A preparation method of the cigarette core material capable of being ignited and heated at low temperature for smoking is also provided, the method comprising:

(1) preparing slice shreds, which comprises:

preparing tobacco film bases by papermaking method using tobacco foam, tobacco stems and tobacco straw as raw materials, proportionally mixing tobacco refined extracts, flavors and fragrances, and smoke additives, obtaining a coating liquid, applying the coating liquid to the tobacco film bases, obtaining slices, drying and shredding the slices for obtaining the slice shreds, wherein a width of the slice shreds is 0.7 mm, the tobacco refined extracts are water-soluble extracts of tobacco; the flavors and fragrances are tobacco flavor or tobacco extracts, the smoke additives are glycerol;

(2) moistening, reinforcing, shredding and flavoring selected tobacco leaves through a traditional shredded tobacco preparation process, and obtaining finished cut tobacco, wherein a width of the cut tobacco is 0.7 mm; and (3) proportionally mixing the slice shreds obtained by the step (1) with the cut tobacco obtained by the step (2), and obtaining the cigarette core material.

Third Embodiment

A cigarette core material, capable of being ignited and heated at low temperature for smoking, comprises 70% of slice shreds and 30% of cut tobacco by weight percentage. The slice shreds comprise 50% of tobacco film bases, 18% of tobacco refined extracts, 5% of flavors and fragrances, and 27% of smoke additives by weight percentage.

A preparation method of the cigarette core material capable of being ignited and heated at low temperature for smoking is also provided, the method comprising:

(1) preparing slice shreds, which comprises:

preparing tobacco film bases by papermaking method using tobacco foam, tobacco stems and tobacco straw as raw materials, proportionally mixing tobacco refined extracts, flavors and fragrances, and smoke additives, obtaining a coating liquid, applying the coating liquid to the tobacco film bases, obtaining slices, drying and shredding the slices for obtaining the slice shreds, wherein a width of the slice shreds is 1.2 mm, the tobacco refined extracts are water-soluble extracts of tobacco: the flavors and fragrances are tobacco flavor or tobacco extracts, the smoke additives are propylene glycol acetate;

(2) moistening, reinforcing, shredding and flavoring selected tobacco leaves through a traditional shredded tobacco preparation process, and obtaining finished cut tobacco, wherein a width of the cut tobacco is 1.2 mm; and (3) proportionally mixing the slice shreds obtained by the step (1) with the cut tobacco obtained by the step (2), and obtaining the cigarette core material.

Product Sensory Quality Assessment and Analysis

The preparation method of the cigarette core material provided by the first embodiment is also applied to prepare samples, and the samples (here, there are ten samples) have different ratios of the slice shreds to the cut tobacco, as shown in Table 1. The prepared cigarette core materials are processed into rod-shaped cigarette products, and then the cigarette products are heated at low temperature for smoking through ignition and electric heating smoking sets (with a same brand and model). Sensory quality inspection is performed on several aspects of the cigarette products such as smoke volume, aroma, mixed gas, coordination, irritation and aftertaste, and specific evaluation results are shown in Table 1.

TABLE 1

Evaluation result statistics of the samples (from the first sample to the tenth sample)

| Sample No. | Ratio of slice shreds | Ratio of cut tobacco | sensory quality statistics under ignition mode | sensory quality statistics under heating mode of heating smoking set | Result |
|---|---|---|---|---|---|
| 1 | 95% | 5% | The aroma is relatively flat, the sense of satisfaction is slightly weaker, the mixed gas is more, the irritation is less, and the comfort is average. | The aroma is average, the sense of satisfaction is weak, the mixed gas is less, the irritation is less, and the comfort is average. | Under this formula ratio, the heating mode of smoking set has a better sensory performance, which is reflected in fuller aroma and relatively less mixed gas. |
| 2 | 90% | 10% | The aroma is flat, the sense of satisfaction is slightly weaker, the mixed gas is slightly more, the irritation is little, and the comfort is slightly better. | The aroma is fuller, the sense of satisfaction is slightly weaker, the mixed gas is little, the irritation is less, and the comfort is slightly better. | Under this formula ratio, the heating mode of smoking set has a better sensory performance, which is reflected in fuller aroma and less mixed gas. |
| 3 | 85% | 15% | The aroma is slightly flat, the sense of satisfaction is slightly weaker, the mixed gas is slightly more, the irritation is less, and the comfort is better. | The aroma is fuller, the satisfaction is slightly weaker, the mixed gas is less, the irritation is less, and the comfort is better. | Under this formula ratio, the heating mode of smoking set has a better sensory performance, which is reflected in fuller aroma and less mixed gas. |
| 4 | 80% | 20% | The aroma is fuller, the sense of satisfaction is slightly weaker, the mixed gas is slightly more, the irritation is less, and the comfort is better. | The aroma is fuller, the sense of satisfaction is better, the mixed gas is less, the irritation is less, and the comfort is better. | Under this formula ratio, the heating mode of smoking set has a better sensory performance, which is reflected in fuller aroma and less mixed gas. |
| 5 | 75% | 25% | The aroma is full, the sense of satisfaction is good, the mixed gas is less, the irritation is less, and the comfort is good. | The aroma is fuller, the sense of satisfaction is better, the mixed gas is less, the irritation is less, and the comfort is better. | Under this formula ratio, the heating mode of smoking set has a better sensory performance, which is reflected in fuller aroma, better sense of satisfaction and less mixed gas. |
| 6 | 70% | 30% | The aroma is full, the sense of satisfaction is good, the mixed gas is little, the irritation is slightly greater, and the comfort is good. | The aroma is full, the sense of satisfaction is better, the mixed gas is less, the irritation is little, and the comfort is good. | Under this formula ratio, the heating mode of smoking set has a better sensory performance, which is reflected in less mixed gas, fuller aroma and better sense of satisfaction. |
| 7 | 65% | 35% | The aroma is fuller, the sense of satisfaction is better, the mixed gas is less, the irritation is slightly greater, and the comfort is slightly worse. | The aroma is full, the sense of satisfaction is good, the mixed gas is little, the irritation is slightly greater, and the comfort is slightly worse. | Under this formula ratio, the ignition mode has a better sensory performance, which is reflected in fuller aroma, better sense of satisfaction and less mixed gas. |
| 8 | 60% | 40% | The aroma is fuller, the sense of satisfaction is better, the mixed gas is less, the irritation is slightly greater, and the comfort is slightly worse. | The aroma is full, the sense of satisfaction is good, the mixed gas is slightly more, the irritation is slightly greater, and the comfort is slightly worse. | Under this formula ratio, the ignition mode has a better sensory performance, which is reflected in less mixed gas, fuller aroma and better sense of satisfaction. |
| 9 | 55% | 45% | The aroma is full, the sense of satisfaction is better, the mixed gas is less, the irritation is great, and the comfort is poor. | The aroma is flat, the sense of satisfaction is slightly weaker, the mixed gas is slightly more, the irritation is great, and the comfort is poor. | Under this formula ratio, the ignition mode has a better sensory performance, which is reflected in less mixed gas, fuller aroma and better sense of satisfaction. |
| 10 | 50% | 50% | The aroma is full, the sense of satisfaction is good, the mixed gas is less, the irritation is great, and the comfort is poor. | The aroma is flat, the sense of satisfaction is weak, the mixed gas is slightly more, the irritation is great, and the comfort is poor. | Under this formula ratio, the ignition mode has a better sensory performance, which is reflected in less mixed gas, full aroma and good sense of satisfaction. |

Ignition for smoking means that cigarettes are lighted for smoking;

Heating but not burning for smoking means that cigarettes are heated through a heating but not burning smoking set for smoking The object of the present invention is to provide a cigarette core material capable of being ignited and heated at low temperature for smoking, which is able to bring a good smoking experience while being ignited and heated at low temperature, thereby maximizing the applicability of cigarette cores. The cigarette core material is prepared by mixing the slice shreds with the cut tobacco in a reasonable ratio. While being heated at low temperature, the cigarette core material is able to release nicotine and tobacco flavor in a balanced manner, providing consumers with a smoking experience closer to the flavor of tobacco. When the smoking set is out of power, the cigarette core material is able to be directly ignited for smoking, the aroma is full, there is no irritation of the tongue and the throat, the aftertaste is comfortable, and the sensory experience is good.

The present invention is a co-product of traditional tobacco and new tobacco. It is also a new product of new market segmentation in the international market. Therefore, it has long-term significance in opening the international tobacco market, occupying overseas market shares, enhancing the influence of state-owned tobacco brands and generating foreign exchange income.

Finally, it should be noted that the above preferred embodiments are only used to illustrate the technical solutions of the present invention and not the limitation to the present invention. Although the present invention has been described in detail through the above preferred embodiments, those skilled in the art should understand that various changes are able to be made to the present invention in form and details without departing from the scope defined by the claims of the present invention.

What is claimed is:

1. A preparation method of a cigarette core material capable of being ignited for smoking and also heated at low a temperature lower than an ignition temperature for smoking, wherein:

the cigarette core material comprises 85-95% of slice shreds and 5-15% of cut tobacco by weight percentage;

the preparation method comprises steps of:

(1) proportionally mixing tobacco refined extracts, flavors and fragrances, and smoke additives, obtaining a coating liquid, applying the coating liquid to tobacco film bases, obtaining slices, drying and shredding the slices, and obtaining slice shreds;

(2) moistening, reinforcing, shredding and flavoring selected tobacco leaves through a shredded tobacco preparation process, and obtaining finished cut tobacco; and (3) proportionally mixing the slice shreds obtained by the step (1) with the cut tobacco obtained by the step (2), and obtaining the cigarette core material.

2. The preparation method of the cigarette core material capable of being ignited for smoking and also heated at a temperature lower than an ignition temperature for smoking according to claim 1, wherein in the step (1), the coating liquid is applied to the tobacco film bases by coating, spraying or dipping.

3. The preparation method of the cigarette core material capable of being ignited for smoking and also heated at a temperature lower than an ignition temperature for smoking according to claim 1, wherein in the steps (1) and (2), a width of both the slice shreds and the cut tobacco is in a range of 0.7 to 1.2 mm.

4. The preparation method of the cigarette core material capable of being ignited for smoking and also heated at a temperature lower than an ignition temperature for smoking according to claim 2, wherein in the steps (1) and (2), a width of both the slice shreds and the cut tobacco is in a range of 0.7 to 1.2 mm.

* * * * *